US010991246B2

(12) United States Patent
Kurehashi

(10) Patent No.: US 10,991,246 B2
(45) Date of Patent: Apr. 27, 2021

(54) DRIVING ASSISTANCE SYSTEM FOR VEHICLE

(71) Applicant: HONDA MOTOR CO., LTD., Tokyo (JP)

(72) Inventor: Takahiro Kurehashi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/824,225

(22) Filed: Mar. 19, 2020

(65) Prior Publication Data

US 2020/0312138 A1 Oct. 1, 2020

(30) Foreign Application Priority Data

Mar. 29, 2019 (JP) ..... JP2019-065503

(51) Int. Cl.
*G08G 1/0968* (2006.01)
*G08G 1/0967* (2006.01)

(52) U.S. Cl.
CPC . *G08G 1/096716* (2013.01); *G08G 1/096783* (2013.01)

(58) Field of Classification Search
CPC ..... G08G 1/0116; G08G 1/0145; G08G 1/096716; G08G 1/096783
See application file for complete search history.

(56) References Cited

U.S. PATENT DOCUMENTS

2016/0148508 A1* 5/2016 Morimoto ..... B60K 37/00 701/117
2017/0124870 A1* 5/2017 Weber ..... G08G 1/096783

FOREIGN PATENT DOCUMENTS

JP 2017-228117 A 12/2017

* cited by examiner

*Primary Examiner* — Andrew W Bee
(74) *Attorney, Agent, or Firm* — Rankin, Hill & Clark LLP

(57) ABSTRACT

A driving assistance system for vehicle, which provides a vehicle with assistance information to pass an intersection, includes: a traffic light information acquisition unit for acquiring turn-on time information of a traffic light arranged at the intersection, a running lane information acquisition unit for acquiring traffic lane configuration and traffic lane-use specification at the intersection, a direction indicator operation detection unit detecting an operation of the direction indicator, and a traffic light passage assistance control unit outputting assistance information including information on possibility to pass through the intersection is obtained based on the turn-on time information of the traffic light corresponding to the traffic lane-use specification of the expected running lane for the vehicle, the expected running lane which is determined based on the traffic lane configuration acquired by the running lane information acquisition unit and on a direction indication of detected by the direction indicator operation detection unit.

4 Claims, 7 Drawing Sheets

| State of Traffic Light | Turned-on Signal Light | Turn-on Time Period |
|---|---|---|
| Step 1 | Green Signal Light | t1 |
| Step 2 | Yellow Signal Light | t2 |
| Step 3 | Red Signal Light & Right Arrow Light | t3 |
| Step 4 | Yellow Signal Light | t4 |
| Step 5 | Red Signal Light | t5 |

DRIVING ASSISTANCE SYSTEM FOR VEHICLE

CROSS-REFERENCE TO RELATED APPLICATIONS

This application is based upon and claims the benefit of priority from Japanese Patent Application No. 2019-065503 filed on Mar. 29, 2019; the entire contents of which are incorporated by reference.

TECHNICAL FIELD

The disclosure relates to a driving assistance system for vehicle which gives a message of driving assistance information to a driver regarding an intersection having a traffic light.

BACKGROUND

Recently, a vehicle or an on-board device called Traffic Signal Prediction Systems (TSPS), which are equipped with a function outputting driving assistance information to a driver of the vehicle, are becoming popular. In particular, when the vehicle passes an intersection provided with a traffic light, the TSPS receives externally a traffic light information including the current light color, turn-on times of light colors of a traffic light located at a traffic intersection, a remaining time until a transition to a next light color occurs (remaining time, waiting time), calculates an arrival time of the vehicle to the intersection, based on the received traffic light information and on the position and the speed of the vehicle, and provides a service of messaging an assistance information, such as a suggestion of deceleration-at-red-signal-light before or passage of the intersection for the vehicle to smoothly pass through the intersection.

Japanese open-laid patent application JP2017228117A discloses a technology related to the TSPS, in which the assistance information is displayed separately regarding the vehicle position and the traffic light position, in order to clearly judge, to which traffic light belongs the obtained information, when there exist multiple traffic lights in the sight of the driver.

SUMMARY OF INVENTION

Technical Problem

According to the technology disclosed in the Japanese open-laid patent application JP2017228117A, passage assistance information for each traffic light at intersections can be provided, even in a case that there exist multiple traffic lights in the sight of the driver.

However, with the technology disclosed in the Japanese open-laid patent application JP2017228117A, in case of an intersection provided with a traffic light having signal lights indicating arrows for respective running directions or provided with traffic lights arranged for respective running lanes, the turn-on timings of the signal lights of the traffic light are different, because the time enabling passage of the vehicle through the intersection is different for respective running directions. Therefore, it is troublesome that the assistance information becomes complicated.

The present invention is devised based on the above context and the purpose of the invention is to provide a driving assistance system for vehicle outputting assistance information including information on possibility to pass through an intersection in correspondence to a running direction of a vehicle, by which a complicated indication of the assistance information for a vehicle can be avoided.

Solution to Problem

In order to solve the above problem, a driving assistance system for vehicle, which provides a vehicle with assistance information to pass an intersection, includes a traffic light information acquisition unit for acquiring turn-on time information of a traffic light arranged at the intersection, a running lane information acquisition unit for acquiring traffic lane configuration and traffic lane-use specification, a direction indicator operation detection unit for detecting an operation of the direction indicator, and a traffic light passage assistance control unit for outputting the assistance information to pass through the intersection, wherein the assistance information including information on possibility to pass through the intersection is obtained based on the turn-on time information of the traffic light corresponding to the traffic lane-use specification for the expected running lane for the vehicle, the expected running lane which is determined based on the traffic lane configuration acquired by the running lane information acquisition unit and on a direction indication of the direction indicator detected by the direction indicator operation detection unit, and that.

Advantageous Effect of the Invention

According to the driving assistance system for vehicle of the disclosure, even in an intersection having a traffic light provided with signal lights corresponding to the running directions, a selection of a signal light conforming to the running direction of the vehicle becomes possible, thereby enabling a provision of the assistance information corresponding to the running direction and facilitating a smooth driving assistance.

DESCRIPTION OF EMBODIMENTS

In the following, embodiments of the present invention will be explained in reference to figures.

It should be noted that the embodiments explained below are for disclosing the idea of the present invention (driving assistance system for vehicle), referring to the Japanese traffic system, driving assistance system, and road infrastructure.

First, a roadside infrastructure for the driving assistance system for a vehicle, a premise for operation of the driving assistance system for vehicle 1 of an embodiment, will be explained.

Figure 1:
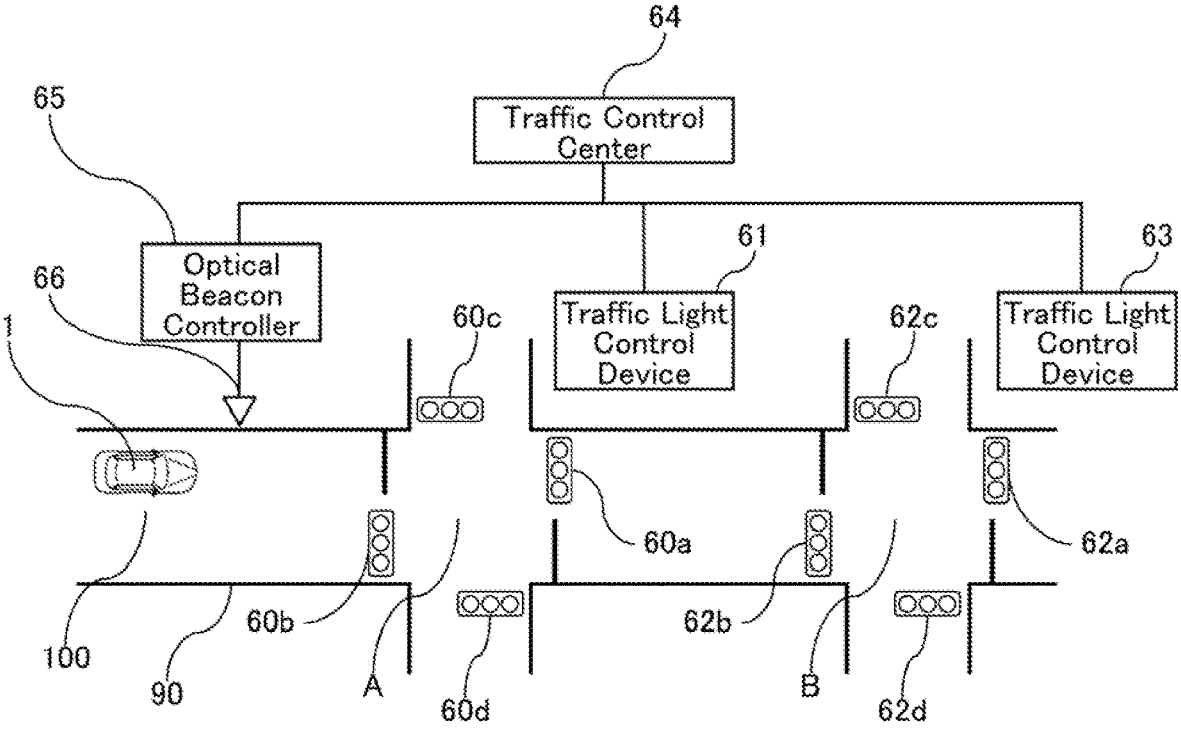
FIG. 1 is a diagram schematically showing a driving safety support system.

FIG. 1 is a diagram schematically showing a driving safety support system (DSSS).

Here, a vehicle 100 equipped with a driving assistance system for vehicle 1 is assumed to travel from left to right on a road 90 provided with an intersection A and an intersection B.

The intersection A is provided with traffic lights 60*a*, 60*b*, 60*c*, 60*d*, of which turn-on timings are controlled by a traffic light control device 61, and the intersection B is provided with traffic lights 62*a*, 62*b*, 62*c*, 62*d*, of which turn-on timings are controlled by a traffic light control device 63.

The traffic light control devices 61, 63 are connected to a traffic control center 64 and control the turn-on and turn-off timings of the signal lights of the traffic lights 60*a*, 60*b*, 60*c*, 60*d*, 62*a*, 62*b*, 62*c*, and 62*d*, based on the control information on turn-on time periods given from the traffic control center for setting the turn-on and turn-off timings of these signal lights (in the present specification, the respective light-emitting units of red, green, yellow colors are noted as signal lights).

The control information of the turn-on times of respective traffic lights are, as traffic light information on route, transmitted from the traffic control center 64 to an optical beacon controller 65.

The optical beacon 66, a wireless communication device for communicating with a vehicle 100 travelling through an intersection, is arranged on a near side of the road 90 from the traffic lights 60*a*, 62*a* and is controlled by the optical beam controller 65.

The optical beacon 66 transmits information including road alignment information such as position information of each intersection shape and stop lines for the vehicle 100, in addition to the traffic light information on route which contains control information of turn-on times of signal lights of traffic lights arranged at intersections of the running road 90.

Though the driving assistance system 1 of the embodiment acquires the traffic signal information on route and the road alignment information via the optical beacon 66 using a near infrared optical communication, a DSRC (Dedicated Short Range Communication) of 5.8 GHz may be used in place of the optical beacon for acquiring the traffic light information on route and the road alignment information.

Further, the driving assistance system for vehicle 1 may acquire the traffic light information on route and the road alignment information from the traffic control center 64 via a roadside device (wireless base station) by use of a road-to-vehicle communication which is a wireless communication system already defined as "700 MHz Band Intelligent Transport Systems" (ARIB STD-T109).

Further, the driving assistance system for vehicle 1 may transmit the position information of the vehicle 100 or the intersection number or the position information of the intersection (information on latitude and longitude) by use of a mobile communication system to the traffic control center 64, and may acquire the traffic light information on route and the road alignment information.

The driving assistance system for vehicle 1 configures the Traffic Signal Prediction Systems (TSPS) which provides the driving assistance information based on the above-mentioned traffic light information on route and road alignment information (shape of intersection, location information of stop line, etc.) and on the position- and velocity information of the vehicle 100.

Figure 2:
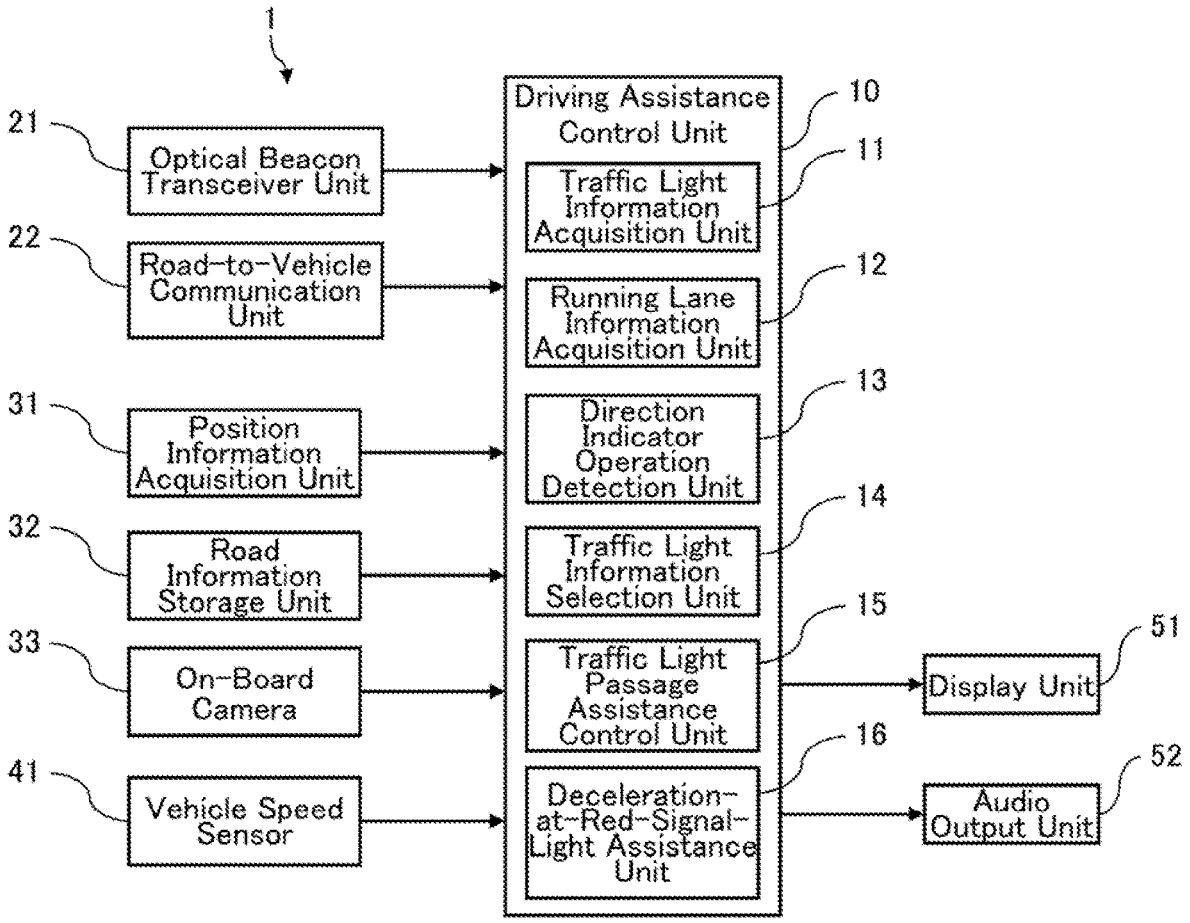
FIG. 2 is a configuration diagram of a driving assistance system for vehicle.

FIG. 2 is a configuration diagram of the driving assistance system for vehicle 1.

The optical beacon transceiver unit 21 is a near infrared communication unit which receives traffic light information on route from the optical beacon 66 (refer to FIG. 1) using downlink and transmits to the optical beacon 66 the vehicle ID and a travelling time using uplink.

The road-to-vehicle communication unit 22 is a communication unit which receives the traffic light information on route and the road alignment information, using the roadside devices arranged at the intersection A and at the intersection B (not shown in the figure) and using the wireless communication of 700 MHz band.

The position information acquisition unit 31 is a processing unit such as the Global Positioning System (GPS), by which a position information of the vehicle 100 is obtained.

The road information storage unit 32 is a storage unit for storing road-map information and position information such as intersection shapes, position information of stop lines, etc., and the information on the types of traffic lights.

The on-board camera 33 is an image capture unit for capturing a forward view image from the vehicle 100 and is an image capture unit for detecting road signs of traffic lane-use specification, "white dotted line", "white continuous line", and "yellow continuous line" showing boundaries of vehicle running lanes, of which signs and lines are drawn on the road surface of the road 90.

The vehicle speed sensor 41 is a speed sensor for detecting the speed of the vehicle 100.

The display unit 51 is a display unit for reporting the driver about the speed range by which the vehicle can pass a forward intersection having a traffic light in a condition that the green signal light is turned on, or for reporting the driver about an accelerator pedal operation necessary to stop before the intersection without applying an unnecessary acceleration/deceleration of the vehicle, when the red signal light of the traffic signal is or expected to be turned on.

The audio output unit 52 is an audio output unit which outputs an alarm sound or voice for calling an attention of the driver to the driving assistance information such as traffic light passage assistance or deceleration assistance towards a traffic light with the red signal light turned on.

The driving assistance control unit 10 is an information processing unit including a microcomputer, input/output unit, etc., and functions as the respective processing units, the traffic light information acquisition unit 11, the running lane information acquisition unit 12, the direction indicator operation detection unit 13, the traffic light information selection unit 14, the traffic light passage assistance control unit 15, and the deceleration-at-red-signal-light assistance control unit 16.

Though, in FIG. 2, the driving assistance system for vehicle 1 of the embodiment is shown as a configuration including both the optical beacon transceiver unit 21 and the road-to-vehicle communication unit 22, it is acceptable if the driving assistance system for vehicle 1 is provided with any one of these units and can acquire the traffic light information on route and the road alignment information.

Further, the driving assistance system for vehicle 1 may be provided with a DSRC transceiver in place of the optical beacon transceiver 21 or the road-to-vehicle communication unit 22.

The driving assistance system for vehicle 1 of the embodiment, more specifically, can be implemented as a functional part of a driving assistance ECU (Electrical Control Unit) or of a car navigation system of the vehicle 100.

Before explaining the detail of the driving assistance control unit 10, an explanation is given for an example of configuration of a traffic light arranged on a road 90 (refer to FIG. 1) for which the driving assistance system for vehicle 1 of the embodiment conducts a driving assistance.

Figures 3, 4:
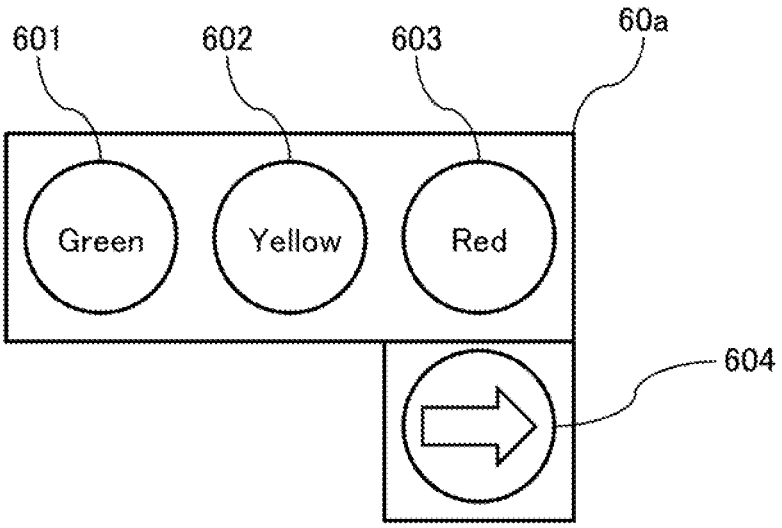
FIG. 3 is a diagram showing an example of configuration of signal lights of a traffic light.
FIG. 4 is a diagram showing a turn-on control information of signal lights.

FIG. 3 is a diagram showing an example of a configuration of signal lights of a traffic light 60*a* arranged ahead at an intersection A in the running direction.

The traffic light 60*a* in FIG. 3 is an arrow-type traffic light including a green signal light 601, a yellow signal light 602, a red signal light 603, and a green arrow signal light only for right-turn.

The traffic light 60*a* turns on the green signal light, the yellow signal light (yellow signal light+green arrow signal light), the red signal light+the green arrow signal light, the yellow signal light and the red signal light in this order for respective predetermined time periods of these signal lights.

The vehicle 100 running straight or turning left is permitted to pass through the intersection when the green signal light 601 is turned on, and the vehicle 100 turning right is permitted to pass through the intersection when the green signal light 601 or the green arrow signal light 604 is turned on.

FIG. 4 is a diagram showing turn-on time periods for the respective turn-on patterns of the signal lights of the traffic light, namely turn-on periods for the respective signal lights or, for example, turn-on of the combination of the red signal light and the green arrow signal light.

In order to control turn-ons of signal lights of the traffic light, the respective turn-on time periods of signal lights, in correspondence to the change of the turn-on status of the signal lights of the traffic signal 60*a*, are stored in the traffic light control device 61.

The traffic control center 64 set the above turn-on control information of the signal lights of the traffic light 60*a* in the traffic light control device 61, and, as the traffic light information on route, the driving assistance system for vehicle 1 of the embodiment acquires information on the turn-on status of the signal lights of the traffic light 60*a* by use of the optical beacon control device 65 and the optical beacon 66.

The timings that the vehicle 100 can pass through the intersection A based on the turn-on status of the traffic light 60*a* are different for the case that the vehicle travels straight or turns to left and for the case that the vehicle turns to right at the intersection A. Therefore, the driving assistance system for vehicle 1 executes the process flows shown in FIG. 5 and FIG. 6, and outputs the driving assistance information specifying a signal light (green signal light 601 or arrow signal light 604) which should be followed.

Figure 5:
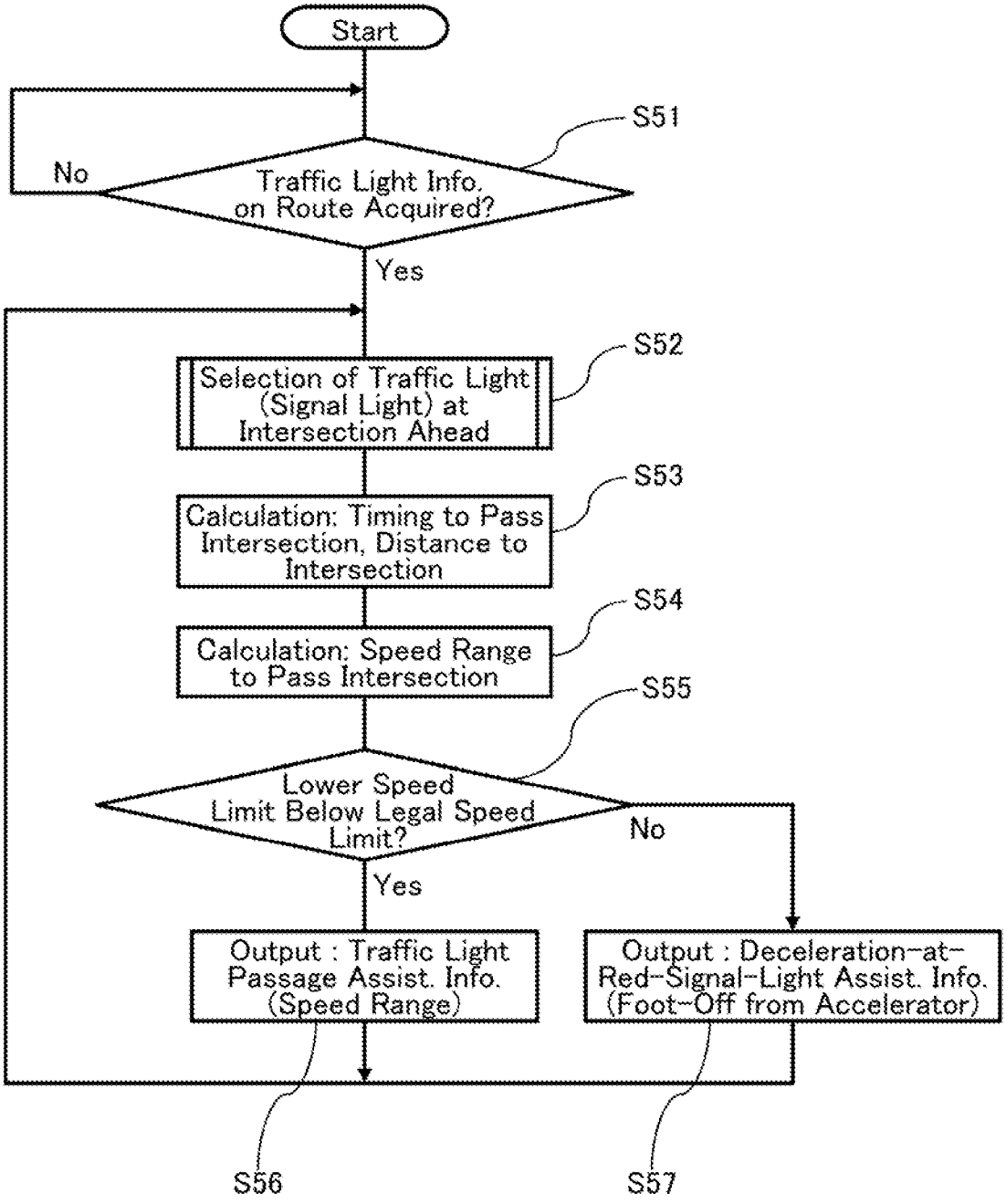
FIG. 5 is a flow diagram explaining an example of an output operation for driving assistance information.

First, in reference to FIG. 5, the output operation for the driving assistance information by the driving assistance system for vehicle 1 is explained.

In step S51, the traffic light information acquisition unit 11 of the driving assistance control unit 10 is in a waiting status for acquiring the traffic light information on route, including the turn-on control information of the traffic lights such as the traffic light 60*a*, from the optical beacon transceiver unit 21 or from the road-to-vehicle communication unit 22.

The traffic light information acquisition unit 11 acquires the traffic light information on route via the optical beacon transceiver unit 21 or via the road-to-vehicle communication unit 22, and then proceeds to step S52 (in case of Yes in S51).

In step S52, the traffic light information selection unit 14 of the driving assistance control unit 10 selects the traffic light (signal lights) indicating a permission of the intersection ahead. Though it will be explained in more detail in reference to FIG. 6, the turn-on timings of the signal lights may be different and the timings that the vehicle can pass through the intersection may be different, when signal lights are provided corresponding to respective running directions. Therefore, the running direction of the vehicle 100 at the intersection is deduced based on the present running lane position, the traffic lane-use specification, and the operation information of the direction indicator, thereby the traffic light (signal light) which should be followed by the driver is specified.

In step S53, the driving assistance control unit 10 calculates the timing that the vehicle can pass the traffic light (signal light) specified in step S52 and the remaining distance to the intersection ahead. In more details, the driving assistance control unit 10 calculates the turn-on and turn-off times of signal lights of the respective turn-on patterns of the traffic light based on the turn-on time periods of the respective signal lights, the turn-on cycle time of the traffic light (sum of the turn-on time periods of the respective turn-on patterns) and the turn-on time of the presently turned-on pattern, and determines the timing that the vehicle can pass through the intersection, which timing is defined by the time period from turn-on to turn-off of a definite signal light permitting passage of the intersection ahead (green light for example) either for the presently turned-on definite turn-on pattern or for the next turn-on of the definite turn-on pattern when this is presently not turned on.

Further, by use of the position information acquisition unit 31, the present position information (for example latitude and longitude) of the vehicle 100 is obtained, and a difference between the present position of the vehicle 100 and the stop line position or the intersection position obtained from the road alignment information acquired via the optical beacon transceiver unit 21 or via the road-to-vehicle communication unit 22, thereby calculating the remaining distance to the intersection ahead.

The driving assistance control unit 10 may refer the road information storage unit 32 and calculate the remaining distance to the intersection ahead from the difference between the position of the intersection about which the assistance information is supplied, based on the map information stored in advance, and the present position of the vehicle 100 of which information is acquired by the position information acquisition unit 31.

In step S54, the driving assistance control unit 10 calculates an upper speed limit of the speed range, which allows passage of the intersection ahead, by dividing the remaining distance calculated in step S53 by the time length from the present time to the start time of the above explained timing that the vehicle can pass through the intersection. Here, when the calculated upper speed limit exceeds the speed limit of the road 90 (legal speed limit), the upper speed limit is set to be the legal speed limit. Further, the driving assistance control unit 10 calculates a lower speed limit of the speed range allowing passage of the intersection ahead by dividing the remaining distance calculated in step S53 by the time length from the present time to the end time of the timing that the vehicle can pass through the intersection. In this way, the speed range allowing passage of the vehicle 100 through the intersection ahead is obtained.

In step S55, the driving assistance control unit 10 determines whether the lower limit of the speed range allowing passage of the intersection ahead is equal to or lower than the speed limit of the road 90 (legal speed limit) or not.

When the lower speed limit is higher than the speed limit of the road 90 (No in S55), the output operation for the driving assistance information proceeds to step S57, as the vehicle 100 is not permitted to travel on the road 90 at such a high speed.

In step S57, the driving assistance control unit 10 controls the display unit 51 and audio output unit 52, using the deceleration-at-red-signal-light assistance control unit 16, and outputs a driving assistance information as a deceleration-at-red-signal-light assistance information, guiding the driver to stop at the stop line of the intersection. For example, the deceleration-at-red-signal-light assistance control unit 16 outputs on the display unit, such as a touch panel, an indication suggesting reduction of acceleration, an indication suggesting foot off from the accelerator pedal, or outputs a voice guidance to the audio output unit 52.

In step S55, when the lower speed limit of the speed range allowing passage of the intersection ahead as calculated in step S54 is equal to or lower than the speed limit of the road 90 (Yes in S55), because the vehicle 100 travelling on the road 90 can pass through the intersection in a speed of the speed range allowing passage of the intersection lower than the speed limit, the output operation for the driving assistance information proceeds to step S56 and outputs the speed range for passing the intersection as the traffic light passage assistance information, using the traffic light passage assistance control unit 15. For example, the traffic light passage assistance control unit 15 outputs an indication of recommended speed range of the vehicle 100 on the display unit, such as a touch panel, or outputs a voice guidance to the audio output unit 52.

The output operation for the driving assistance information returns to step S52 after the process of step S57, and the driving assistance control unit 10 repeats cyclically the output operation for the driving assistance information until the vehicle 100 passes the traffic light for which the traffic light information on route is acquired in step S51.

In the process flow shown in FIG. 5, when the intersection is congested or jammed up, because it is not possible to travel in the recommended speed range, the driving assistance control unit 10 determines whether the vehicle 100 is travelling in the recommended speed range or not based on the vehicle speed measured with the vehicle speed sensor 41, and may stop outputting the traffic light passage assistance information, in case that the vehicle 100 is not moving for certain period in the recommended speed range. In this way, the impression regarding reliability of the driving assistance information can be improved.

In addition, the driving assistance control unit 10 may also be so arranged that the traffic jam information for the road for which the traffic light information on route is acquired, via the optical beacon transceiver unit 21 or via the road-to-vehicle communication unit 22, and that the driving assistance information based on the traffic light information on route is not outputted for a congesting intersection.

Figure 6:
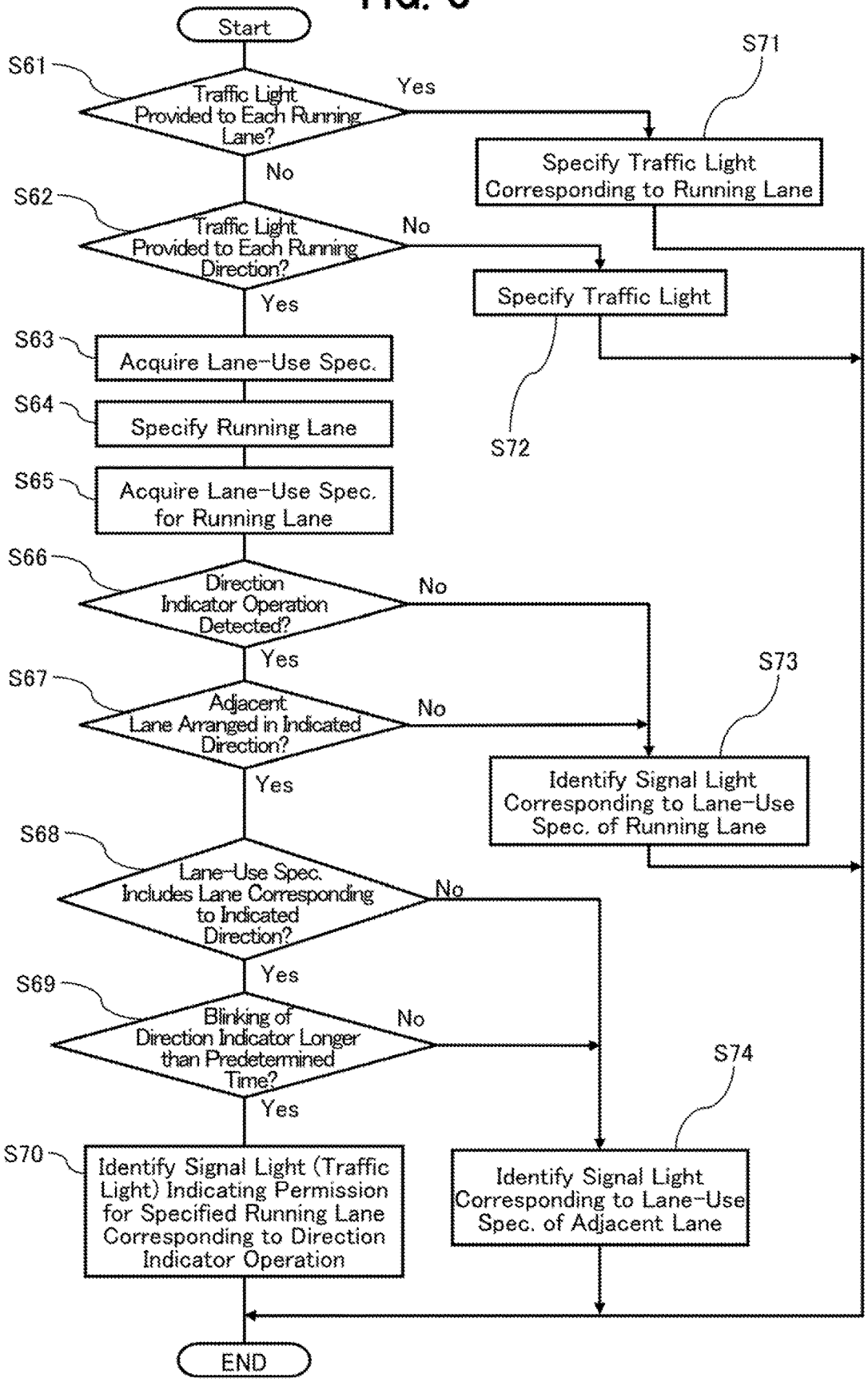
FIG. 6 is a flow diagram explaining a process of selection of a traffic signal (a signal light).

Next, in reference to FIG. 6, the procedure that the traffic light information selection unit 14 specifies the traffic light (signal light) which indicates passage permission of the vehicle 100 at the intersection ahead is explained in detail.

In step S61, the traffic light information selection unit 14 refers the traffic light information on route which has been acquired in step S51, and determines whether a traffic light is provided or not to each lane at the intersection ahead which the vehicle 100 is going to pass. When a traffic light is provided to each lane (vehicle running lane) (Yes in S61), then the procedure proceeds to step S71, otherwise (No in S61) the procedure proceeds to step S62.

In step S61, the traffic light information selection unit 14 may refer the road information storage unit 32 and acquire the stored information in advance on the types of the traffic lights for determining whether a traffic light is provided to each lane or not.

In step S62, the traffic light information selection unit 14 refers the traffic light information on route and determines whether a signal light is provided to each running direction (arrow-type traffic light) or not. In case that the traffic light is an arrow-type traffic light (Yes in S62), the procedure proceeds to step S63, otherwise (No in S62) proceeds to step S72.

In step S62, the traffic light information selection unit 14 may refer the road information storage unit 32 and acquire the information on the types of the traffic lights for determining whether the traffic light is of an arrow-type or not.

In step S63, the traffic light information selection unit 14 acquires the number of lanes on the road 90 that the vehicle 100 travels and the information on use of respective lanes (lane-use specification), via the running lane information acquisition unit 12.

In more detail, the running lane information acquisition unit 12 analyses the front view image of the vehicle 100, through which the vehicle running lanes are identified, the number of lanes is obtained, and the traffic lane-use specification information is obtained by identifying the road signs drawn on the respective running lanes indicating the running direction and the road sign board.

Further, the running lane information acquisition unit 12 may obtain the number of lanes and the traffic lane-use specification information based on the traffic light information on route and the road alignment information, which information is received via the optical beacon transceiver unit 21 or via the road-to-vehicle communication unit 22.

In step S64, the traffic light information selection unit specifies the lane that the vehicle 100 runs.

In more detail, the traffic light information selection unit 14 obtains the running lane of the vehicle 100 by assuming the running lane of directly forward direction of the vehicle 100 among the running lanes of the captured image by the on-board camera 33 to be the running lane of the vehicle 100, or by use of the running lane information received from the optical beacon 66 via the optical beacon transceiver unit 21.

In step S65, the traffic light information selection unit 14 acquires the lane-use specification of the running lane of the vehicle 100.

Thereafter, the running lane of the vehicle 100 and the running direction of the vehicle on the running lane or at the intersection are deduced monitoring the driver's operation, and the process for specifying the traffic light (signal light) corresponding to the running direction is conducted. In particular, when a movement is detected that in front of the intersection the vehicle is running on the right- or left-turn lane, or when an driver's operation for changing the running lane to a right- or left-turn lane is detected, or when both the movement and the operation are detected, it is arranged to select the traffic light (signal light) which indicates passage permission of the lane concerned.

In step S66, the traffic light information selection unit 14 determines whether an operation of the direction indicator for a right-turn or a left-turn is detected or not, using the direction indicator operation detection unit 13. When the direction indicator is not operated (No in S66), the traffic light information selection unit 14 assumes that the vehicle 100 pass through the intersection along the present running lane, and the procedure proceeds to step S73. When an operation of the direction indicator is detected (Yes in S66), then the procedure proceeds to step S67.

In step S67, the traffic light information selection unit 14 acquires the direction indicated by an operation of the direction indicator from the direction indicator operation detection unit 13 and determines whether there exists another adjacent lane (another running lane), different to the present running lane, in the direction indicated by the direction indicator. In this case, it is identified that this adjacent lane includes an additional lane for the straight direction. When there is no adjacent lane in the direction indicated by the operation of the direction indicator (No in step S67), the operation of the direction indicator is identified to be the operation for the right- or left turn, and the procedure proceeds to step S68.

In step S68, the traffic light information selection unit 14 determines whether a right- or left turn lane corresponding to the direction, which is indicated by the operation of the direction indicator and detected by the direction indicator operation detection unit 13, is included in the lane-use specification or not. When the right- or left turn lane is not included in the lane-use specification (No in step S68), the operation of the direction indicator is identified to be the operation for changing to the adjacent lane, and then the procedure proceeds to step S74. When the right- or left turn lane is included in the lane-use specification (Yes in step S68), the procedure proceeds to step S69. In particular, in step S69, it is identified that the vehicle changes the running lane to the left adjacent lane which is for turning left/travelling straight.

In step S69, the traffic light information selection unit 14 determines whether the direction indicator operation detection unit 13 has detected a blinking time of the direction indicator longer than a predetermined time or not. When the blinking time of the direction indicator is shorter than the predetermined time (No in S69), it is identified that the operation of the direction indicator is the operation for indicating change of the running lane, and the procedure proceeds to step S74. When the blinking time of the direction indicator is equal to or longer than the predetermined time (Yes in S69), the operation of the direction indicator is identified to be the operation for right- or left turn, and the procedure proceeds to step S70.

In step S70, the traffic light information selection unit 14 specifies the signal light which indicates a permission for the vehicle to travel along the specified running lane, and then the procedure is terminated.

In step S71, because at the intersection ahead a traffic light is arranged for each running lane, the traffic light information selection unit 14 specifies the running lane for the vehicle 100 and the traffic light corresponding to the running lane, similarly to the case of step S64, and then the procedure is terminated.

In step S72, because at the intersection ahead the traffic light does not indicate permission of travelling separately for respective travelling directions, the traffic light information selection unit 14 specifies the traffic light arranged at the intersection, and then the procedure is terminated.

In step S73, the traffic light information selection unit 14 identifies the signal light to be corresponding to the lane-use specification of the running lane specified in step S64, and then the procedure is terminated.

In step S74, because it is identified that the operation of the direction indicator is for changing the running lane, the traffic light information selection unit 14 identifies the signal light to be corresponding to the lane-use specification of the adjacent lane, and then the procedure is terminated.

For the traffic light information selection unit 14, it has been explained above that the travelling direction of the vehicle 100 is deduced from the configurations of the traffic lights of the intersection and the running lanes at the intersection, the direction indicator operation and the running lane, and that the procedure is conducted for identifying the signal light which indicates a permission to travel the running lane corresponding to the running direction of the vehicle 100. In place of this procedure, another procedure can be employed in which the traffic light information selection unit 14 acquires the information on the travelling directions at the intersections of the travel route from the navigation system (not shown in the figure) providing the information on route from the present location to the destination, the running direction is obtained for the intersection for which the driving assistance information is provided, and the traffic light (signal light) indicating a permission for travelling in the obtained running direction is identified.

Figure 7:
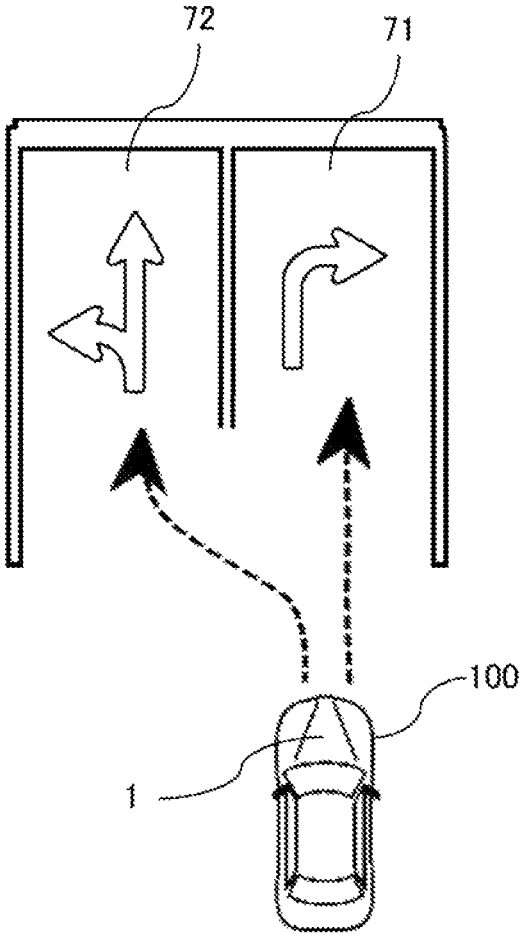
FIG. 7 is a diagram explaining a vehicle's behavior by an intersection provided with a lane for turning right and a lane for travelling straight/turning left.
Figure 8:
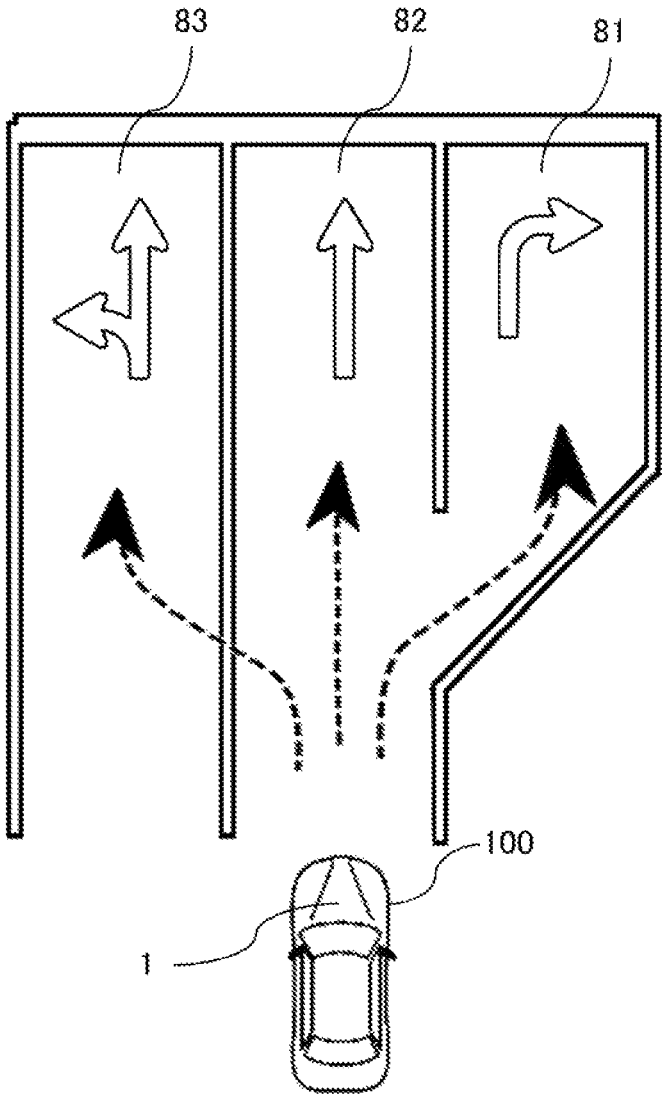
FIG. 8 is a diagram explaining a vehicle's behavior by an intersection provided with an additional lane for turning right, a lane for travelling straight, and a lane for turning left/travelling straight.

Next, referring to FIG. 7 and FIG. 8, a more specific explanation is given for an operation example of the driving assistance system for vehicle at an intersection, especially regarding the traffic light information selection unit 14.

FIG. 7 shows an intersection which is provided with a running lane specified for right-turn (hereinafter called as first running lane 71), a running lane specified for travelling straight and left-turn (hereinafter called as second running lane 72), and a traffic light having a green arrow signal light only for right-turn as shown in FIG. 3. Namely, the vehicle 100 passes the intersection following the green signal light and the arrow signal light when travelling the first running lane 71 and following the green signal light when travelling the second running lane 72.

It will be explained for the case that the vehicle 100 having the driving assistance system for vehicle travels from lower side in FIG. 7 to upper side on the first running lane 71 or on the second running lane 72, whereby the vehicle 100 turns right, travels straight, or turns left.

First, the case that the vehicle 100 travels on the first running lane 71 to pass through the intersection is explained.

As at the intersection of FIG. 7 a traffic light is provided not to each running lane separately, but one traffic light having an arrow signal light for right-turn is arranged, the traffic light information selection unit 14 conducts the processes of step S63 and thereafter. In steps S63 to S65, it is identified that the first running lane, on which the vehicle 100 travels, is a running lane for right-turn.

In step S66, the traffic light information selection unit 14 assumes that the vehicle 100 turns right following the lane-use specification of the first running lane 71 and identifies the green signal light and the arrow signal light of the traffic light to be for passing the intersection, even when an operation of the direction indicator is not detected.

When an operation of the direction indicator for turning right is detected in step S66, the traffic light information selection unit 14 conducts the process of step S73, and identifies the green signal light and the arrow signal light of the traffic signal in similar to the above, because there is no running lane on the right side of the first running lane 71.

When an operation of the direction indicator for left-turn is detected in step S66, the traffic light information selection unit 14 conducts the process of step S68, because there is the second running lane 72 on the left side of the first running lane 71.

Because it is identified in step S68 that lane-use specification of the second running lane 72 is for travelling straight or turning left, which does not contradict with the above operation of the direction indicator for turning left, then the traffic light information selection unit 14 conducts the process of step S69.

In step S69, the traffic light information selection unit 14 determines whether the direction indicator operation is for running lane change or for turning left, based on whether the blinking time of the direction indicator longer than a predetermined time is detected or not. When the blinking time is shorter than the predetermined time, it is determined that the direction indicator operation is for running lane change, then the traffic light information selection unit 14 conducts the process of step S74 and identifies the green signal light for travelling the second running lane having the lane-use specification of turning left and/or travelling straight to be the traffic light (signal light) for passing straight the intersection. When the blinking time is equal to or longer than the predetermined time, it is determined that the direction indicator operation is for turning left, and then the traffic light information selection unit 14 identifies the green signal light to be the traffic light (signal light) for turning left.

Next, it will be explained for the case that the vehicle 100 travels on the second running lane 72 and passes the intersection.

In steps S61 to S65, the traffic light information selection unit 14 identifies the running lane of the vehicle 100 to be the running lane for turning left/travelling straight.

When no direction indicator operation is detected in step S66, the traffic light information selection unit 14 assumes that the vehicle 100 travels straight following the lane-use specification of the second running lane 72, and identifies the green signal light of the traffic light to be the green signal light for passing the intersection.

When a direction indicator operation is detected in step S66, because there is not a running lane on the left side of the second running lane 72, the traffic light information selection unit 14 assumes that the vehicle 100 turns left and conducts the process of step S73, whereby the green signal light of the traffic light is identified to be the green signal light for turning left at the intersection.

When a direction indicator operation for turning right is detected in step S66, because there is the first running lane 71 on the right side of the second running lane 72, the traffic light information selection unit 14 conducts the process of step S68.

Because it is identified in step S68 that lane-use specification of the first running lane 71 is for turning right, which does not contradict with the above operation of the direction indicator for turning right, then the traffic light information selection unit 14 conducts the process of step S69.

Based on whether the blinking time of the direction indicator equal to or longer than the predetermined time is detected or not in step S69, the traffic light information selection unit 14 determines whether the direction indicator operation is for changing the running lane or for turning right. When the blinking time of the direction indicator is shorter than the predetermined time, the direction indicator operation is determined to be the operation for changing the running lane, and the traffic light information selection unit 14 conducts the process of step S74, whereby the arrow signal light for turning right and the green signal light are specified to be the traffic light (signal light) of the lane-use specification of the first running lane 71 for passing the intersection. Further, when the blinking time of the direction indicator is equal to or longer than the predetermined time, the traffic light information selection unit 14 determines the direction indicator operation to be the operation for turning right and identifies the arrow signal light and the green signal light to be the traffic light (signal light) for indicating right-turn.

FIG. 8 shows an intersection provided with an additional lane for turning right (hereinafter called as first running lane 81), a lane for travelling straight (hereinafter called as second running lane 82), a lane for turning left/travelling straight (hereinafter called as third running lane 83), and a traffic light having a green arrow signal light used only for turning right as shown in FIG. 3. Namely, the vehicle 100 passes the intersection, following the green signal light and the arrow signal light when travelling the first running lane 81, and following the green signal light when travelling the second running lane 82 or the third running lane 83.

In the following it will be explained about the case that the vehicle 100 having the driving assistance system 1 travels from lower side to upper side on the running lane 82 or on the running lane 83 in FIG. 8, then turns right/travels straight/turns left at the intersection.

First, it will be explained about a case that the vehicle 100 travels on a portion of the running lane which continues to be the second running lane 82 and which portion is the portion before branching to the first running lane 81 for turning right.

Because the intersection shown in FIG. 8 is not provided with separate traffic lights for respective running lanes but one traffic light having an arrow signal light for turning right, in FIG. 6, the traffic light information selection unit 14 conducts the process of step S63. In steps S63 to S65, the traffic light information selection unit 14 identifies that the running lane on which the vehicle 100 travels is a running lane for travelling straight.

When in step S66 no direction indicator operation is detected, then the traffic light information selection unit 14 assumes that the vehicle 100 travels straight following the lane-use specification of the second running lane 82, and in step S73 the traffic light information selection unit 14 identifies the green signal light to be for passing the intersection following this green signal light.

When in step S66 a direction indicator operation for turning right is detected, because there is the first running lane 81 on the right side ahead, then the traffic light information selection unit 14 conducts process of step S68.

Because in step S68 it is identified that the first running lane is of the lane-use specification for turning right, the direction indicator operation for turning right is in agreement with the lane-use specification, then the traffic light information selection unit 14 conducts process of step S69.

Based on whether the blinking time of the direction indicator equal to or longer than the predetermined time is detected or not in step S69, the traffic light information selection unit 14 determines whether the direction indicator operation is for changing the running lane or for turning right. When the blinking time of the direction indicator is shorter than the predetermined time, the direction indicator operation is determined to be the operation for changing the running lane, and the traffic light information selection unit 14 conducts the process of step S74, whereby the arrow signal light is identified to be the traffic light (signal light) of the lane-use specification of the first running lane 81 for passing the intersection. Further, when the blinking time of the direction indicator is equal to or longer than the predetermined time, the traffic light information selection unit 14 determines the direction indicator operation to be the operation for turning right and identifies the arrow signal light to be the traffic light (signal light) for indicating right-turn.

When in step S66 a direction indicator operation for turning right is detected, because there is the third running lane 83 on the left side of the second running lane 82, then the traffic light information selection unit 14 conducts process of step S68.

Because, in step S68, it is identified that the third running lane is of the lane-use specification for travelling straight or turning left, the direction indicator operation for turning left is in agreement with the lane-use specification, then the traffic light information selection unit 14 conducts process of step S69.

Based on whether the blinking time of the direction indicator equal to or longer than the predetermined time is detected or not in step S69, the traffic light information selection unit 14 determines whether the direction indicator operation is for changing the running lane or for turning left. When the blinking time of the direction indicator is shorter than the predetermined time, the direction indicator operation is determined to be the operation for changing the running lane, and the traffic light information selection unit 14 conducts the process of step S74, whereby the green signal light is identified to be the traffic light (signal light) of the lane-use specification of the first running lane 83 for turning left or travelling straight. Further, when the blinking time of the direction indicator is equal to or longer than the predetermined time, the traffic light information selection unit 14 determines the direction indicator operation to be the operation for turning left and identifies the green signal light to be the traffic light (signal light) for indicating left-turn.

Next, it will be explained about the case that the vehicle 100 travels on the third running lane 83 and passes the intersection.

The traffic light information selection unit 14 identifies, in steps S61 to S65, that the running lane on which the vehicle 100 travels is a running lane for turning left/travelling straight.

When no direction indicator operation is detected in step S66, the traffic light information selection unit 14 assumes that the vehicle 100 travels straight following the lane-use specification of the third running lane 83, and identifies the green signal light of the traffic light to be the green signal light for passing the intersection.

When a direction indicator operation is detected in step S66, because there is not a running lane on the left side of the third running lane 83, the traffic light information selection unit 14 assumes that the vehicle 100 turns left and conducts the process of step S73, whereby the green signal light of the traffic light is identified to be the green signal light for turning left at the intersection.

When in step S66 a direction indicator operation for turning right is detected, because there is the first running lane 81 and the second running lane 82 on the right side of the third running lane 83 ahead, then the traffic light information selection unit 14 conducts process of step S68.

Because, in step S68, it is identified that the first running lane 81 is of the lane-use specification for turning right, the direction indicator operation for turning right is in agreement with the lane-use specification, then the traffic light information selection unit 14 conducts process of step S69.

Based on whether the blinking time of the direction indicator equal to or longer than the predetermined time is detected or not in step S69, the traffic light information selection unit 14 determines whether the direction indicator operation is for changing the running lane or for turning right. When the blinking time of the direction indicator is shorter than the predetermined time, the direction indicator operation is determined to be the operation for changing the running lane, and the traffic light information selection unit 14 conducts the process of step S74, whereby the green signal light of the lane-use specification of the first running lane 82 is identified to be the traffic light (signal light) for travelling straight. Further, when the blinking time of the direction indicator is equal to or longer than the predetermined time, the traffic light information selection unit 14 determines the direction indicator operation to be the operation for turning right and identifies the arrow signal light and the green signal light to be the traffic light (signal light) for indicating right-turn.

Above it has been explained about the present invention (driving assistance system for vehicle), referring to the Japanese traffic system, driving assistance system, and road infrastructure. It would be apparent for a person skilled in the art to apply the idea disclosed in the present invention in the countries other than Japan, using the respective traffic system, driving assistance system and road infrastructure for driving assistance.

For example, though the driving assistance system 1 in the above embodiments are explained for the case of left-hand traffic, it would be easy to apply the present invention in the countries of right-hand traffic, by reading the left-hand travelling of the vehicle 100 as the right-hand travelling.

The invention claimed is:

1. A driving assistance system for vehicle, which provides a vehicle with assistance information to pass an intersection, comprising: a traffic light information acquisition unit configured to acquire turn-on time information of a traffic light arranged at the intersection, a running lane information acquisition unit configured to acquire traffic lane configuration and traffic lane-use specification at the intersection, a direction indicator operation detection unit configured to detect an operation of the direction indicator, and a traffic light passage assistance control unit configured to output the assistance information to pass through the intersection, wherein the assistance information including information on possibility to pass through the intersection is obtained based on the turn-on time information of the traffic light corresponding to the traffic lane-use specification of an expected running lane for the vehicle, the expected running lane which is determined based on the traffic lane configuration acquired by the running lane information acquisition unit and on a direction indication of the direction indicator detected by the direction indicator operation detection unit.

2. The driving assistance system for vehicle according to claim 1, wherein the traffic light passage assistance control unit determines whether to identify a running lane corresponding to a direction indicated by a direction indicator operation or not, and when identifying no adjacent lane, the traffic light passage assistance control unit identifies the expected running lane as a present running lane.

3. The driving assistance system for vehicle according to claim 1, wherein the traffic light passage assistance control unit determines whether to identify a running lane corresponding to a direction indicated by a direction indicator operation or not, and when identifying an adjacent lane, the traffic light passage assistance control unit identifies the expected running lane as the adjacent running lane.

4. The driving assistance system for vehicle according to claim 1, wherein, when an indication time period of a direction indication by the direction indicator is equal to or longer than a predetermined time, the traffic light passage assistance control unit identifies a direction indication by the direction indicator as a direction indication for right- or left-turn, and outputs an assistance information to pass through the intersection, which assistance information including information on possibility to pass through the intersection is obtained from the turn-on time information of the traffic light corresponding to the traffic lane-use specification for the expected running lane, and when an indication time period of a direction indication by the direction indicator is shorter than a predetermined time, the traffic light passage assistance control unit identifies a direction indication by the direction indicator as an indication of running lane change, and outputs an assistance information to pass through the intersection, which assistance information including information on possibility to pass through the intersection is obtained from the turn-on time information of the traffic light corresponding to the traffic lane-use specification for the expected running lane.

* * * * *